US010376065B1

(12) United States Patent
Lai et al.

(10) Patent No.: US 10,376,065 B1
(45) Date of Patent: Aug. 13, 2019

(54) ADJUSTABLE LIFTING STRUCTURE FOR CHAIR BACK

(71) Applicants: Yen-Chuan Lai, Taibao (TW); Yen-Ji Lai, Taibao (TW)

(72) Inventors: Yen-Chuan Lai, Taibao (TW); Yen-Ji Lai, Taibao (TW)

( * ) Notice: Subject to any disclaimer, the term of this patent is extended or adjusted under 35 U.S.C. 154(b) by 0 days.

(21) Appl. No.: 15/939,457

(22) Filed: Mar. 29, 2018

(51) Int. Cl.
*A47C 7/40* (2006.01)

(52) U.S. Cl.
CPC ..... *A47C 7/402* (2013.01)

(58) Field of Classification Search
None
See application file for complete search history.

(56) References Cited

U.S. PATENT DOCUMENTS 5,286,088 A * 2/1994 Taylor ..... A47C 1/03255 297/300.1
5,324,096 A * 6/1994 Schultz ..... A47C 1/03 297/353
6,299,253 B1 * 10/2001 Chen ..... A47C 7/402 297/353
6,709,059 B1 * 3/2004 Cvek ..... A47C 7/402 297/353
7,360,837 B1 * 4/2008 Liu ..... A47C 7/402 297/353
2016/0206104 A1 * 7/2016 Cybulski ..... A47C 1/03

* cited by examiner

*Primary Examiner* — David E Allred
(74) *Attorney, Agent, or Firm* — Alan D. Kamrath; Mayer & Williams PC

(57) ABSTRACT

An adjustable lifting structure for a chair back contains: a first adjustment unit and a second adjustment unit. The first adjustment unit mates with the second adjustment unit via a transmission cable, and the first adjustment unit includes a longitudinally hollow chamber for slidably accommodating a guide plate connected on a seat. The first adjustment unit includes a body and two covering assemblies. A drive block includes a locking space, a slit, two deformable chambers, a trough, and two projections. The guide plate includes a conducting element and a rail having multiple teeth and multiple cutouts. The second adjustment unit includes an adjuster, an operation cavity, a first aperture, a connecting room, and two stop segments. A transmission cable includes a first transmitting segment and a second transmitting segment, wherein the first transmitting segment has a first defining portion, and the second transmitting segment has a second defining portion.

2 Claims, 16 Drawing Sheets

ADJUSTABLE LIFTING STRUCTURE FOR CHAIR BACK

BACKGROUND OF THE INVENTION

Field of the Invention

The present invention relates to an adjustable lifting structure for a chair back.

Description of the Prior Art

A conventional chair is employed to be sat upon for people based on using requirements in a variety of places. Comfortable sitting, chic appearance, ergonomics using, and easy laying adjustment are required for the conventional chair. However, it is impossible to adjust a height of the conventional chair.

The present invention has arisen to mitigate and/or obviate the afore-described disadvantages.

SUMMARY OF THE INVENTION

The primary objective of the present invention is to provide an adjustable lifting structure for a chair back which adjustably lifts and fixes the chair back and a seat by ways of a guide plate, and a second adjustment unit is turned and fixed easily based on customized requirements.

To obtain above-mentioned objective, an adjustable lifting structure for a chair back provided by the present invention contains: a first adjustment unit and a second adjustment unit.

The first adjustment unit mates with the second adjustment unit via a transmission cable, and the first adjustment unit includes a longitudinally hollow chamber formed therein vertically and configured to slidably accommodate the guide plate, and a bottom of the guide plate is connected on a seat, the first adjustment unit is disposed on a rear surface of the chair back, and the second adjustment unit is fixed on the rear surface of the chair back.

The first adjustment unit includes a body, two covering assemblies connected on a front end and a rear end of the body respectively so that the longitudinally hollow chamber is defined among the body and the two covering assemblies, the body has a protrusion arranged on the front end of the body, a receiving groove formed in the protrusion and having a guiding recess defined on a first end of the receiving groove, a limiting segment arranged on a second end of the receiving groove, a slide recess extending from a center of the limiting segment, two flexible spaces formed on two side of the slide recess individually, a first conduct recess defined on a distal end of the slide recess, and a second conduct recess extending from an end of the first conduct recess.

The body further includes multiple first connection portions and a first coupling orifice which are formed on two sides of the body respectively, wherein the multiple first connection portions and the first coupling orifice are configured to connect with each of the two covering assemblies, and the body includes multiple second coupling orifices defined thereof and configured to fix the body on the chair back; the body includes a first trench defined on the rear end thereof and includes a second trench longitudinally formed on the body, wherein the first trench has an engagement element mounted thereof adjacent to a top of the first trench, and the engagement element has a screwing portion defined on an end thereof so as to screw on the body.

The drive block includes a locking space defined on a front surface thereof, a slit extending from an end of the locking space, two deformable chambers defined on two sides of the locking space respectively, a driving segment formed on a first end of the drive block, a retainer formed on a rear surface of the drive block, a trough defined on a center of a side of the retainer, and two projections formed on two sides of the trough respectively; wherein the retainer is accommodated in the receiving groove of the body so that the locking space and the two deformable chambers are defined outwardly, the retainer is formed inwardly, and the trough and the two projections correspond to the second trench of the body.

The guide plate includes a conducting element arranged on a surface thereof, a rail defined on a side of the conducting element so that after the guide plate is slidably accommodated in the first trench of the body, the rail is slidably housed in the second trench; the rail has multiple teeth and multiple cutouts which are connected together, and each of the multiple teeth is defined between any two adjacent of the multiple cutouts, such that the multiple teeth and the multiple cutouts individually correspond to and retain with the two projections and the trough of the drive block; the conducting element has a channel longitudinally formed thereof and configured to slidably house the engagement element of the body, wherein the channel has two raised portions extending inwardly and located adjacent to a top of the channel so as to abut against two sides of the engagement element respectively; the guide plate further includes two stopping posts arranged on a rear end of the guide plate adjacent to two sides of a distal end of the conducting element respectively, and each of the two stopping posts retains on a bottom rim of the second lid of each covering assembly of the first adjustment unit.

The second adjustment unit includes an adjuster, an operation cavity defined in the adjuster, a first aperture formed on a first end of the operation cavity, wherein the first aperture has two first shoulders formed on two inner surfaces thereof respectively, two connecting rooms formed on a second end of the operation cavity, two stop segments formed on two distal ends of two sides of the connecting room individually, and the two connection rooms have two second shoulders individually formed on two distal ends of the two connection rooms. The adjuster further has a second aperture defined on a first side thereof, an indentation arranged on a second side of the adjuster opposite to the first side of the adjuster, a third aperture defined on the adjuster such that a fixing element inserts through the third aperture so as to connect with a second connection portion of an adjustment cover which is coupled on the adjuster; a movable rod is slidably housed in the operation cavity of the adjuster, the movable rod includes a third shoulder movably stopped on the two first shoulders of the first aperture, wherein the movable rod has a recessed segment defined on a first end thereof and slidably limited by two stop segments of the adjuster, two positioning columns respectively extending from two sides of an inner wall of the recessed segment and configured to fit with the two resilient elements respectively, two lock blocks are respectively arranged on the two sides of the inner wall of the recessed segment proximate to the two positioning columns, hence the two resilient elements are accommodated in the connecting room of the adjuster and stop on the two lock blocks individually, another end of each resilient element stops on the two second shoulders, the movable rod has a notch corresponding to the second aperture and the indentation of the adjuster, and the movable rod includes a locating segment formed on another end thereof and a receiving orifice defined on an inner surface of the locating segment; a press element has a defining portion corresponding to the receiving orifice, the defining portion and the receiving orifice facilitate a connection of the press element and the locating segment of the movable rod via a mounting element.

The transmission cable includes a first transmitting segment and a second transmitting segment which are defined on two ends of the transmission cable respectively, wherein the first transmitting segment has a first defining portion formed on a distal end thereof, and the second transmitting segment has a second defining portion defined on a distal end thereof, wherein the first transmitting segment is fixed in the second aperture of the adjuster, the notch of the movable rod, and a dent of the adjuster so that the first defining portion of the distal end of the first transmitting segment is limited in the indentation of the adjuster; the second transmitting segment is fixed in the second conduct recess and the first conduct recess of the body and the slit of the drive block so that the second defining portion of the distal end of the second transmitting segment is limited in the locking space of the drive block.

BRIEF DESCRIPTION OF THE DRAWINGS

FIG. 3-1 is a perspective view showing the assembly of a drive block of the adjustable lifting structure for the chair back according to the preferred embodiment of the present invention.

FIG. 3-2 is another perspective view showing the assembly of the drive block of the adjustable lifting structure for the chair back according to the preferred embodiment of the present invention.

FIG. 3-3 is a perspective view showing the assembly of a part of the adjustable lifting structure for the chair back according to the preferred embodiment of the present invention.

DETAILED DESCRIPTION OF THE PREFERRED EMBODIMENTS

Figure 1:
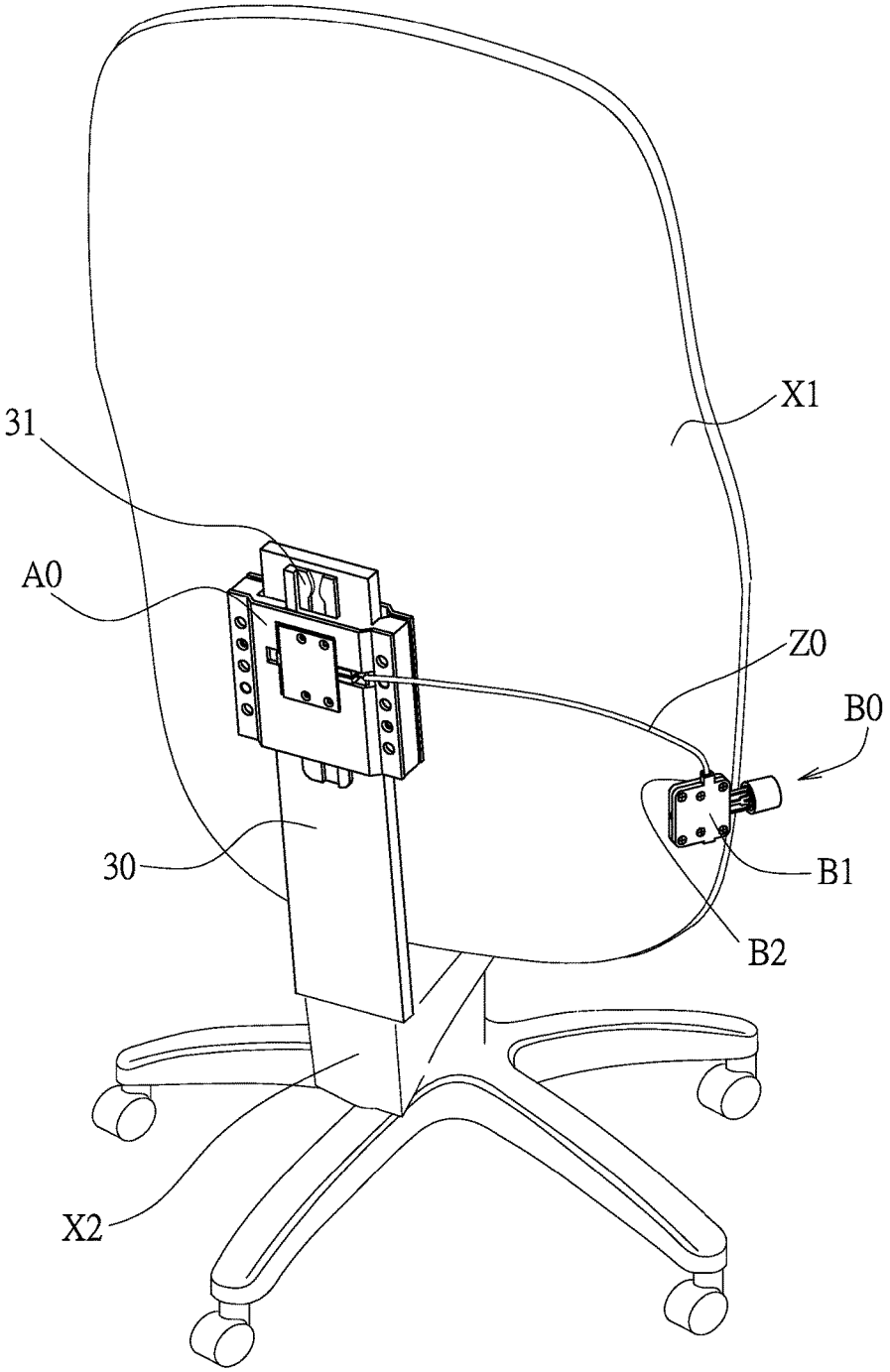
FIG. 1 is a perspective view showing the assembly of an adjustable lifting structure for a chair back according to a preferred embodiment of the present invention.
Figure 2:
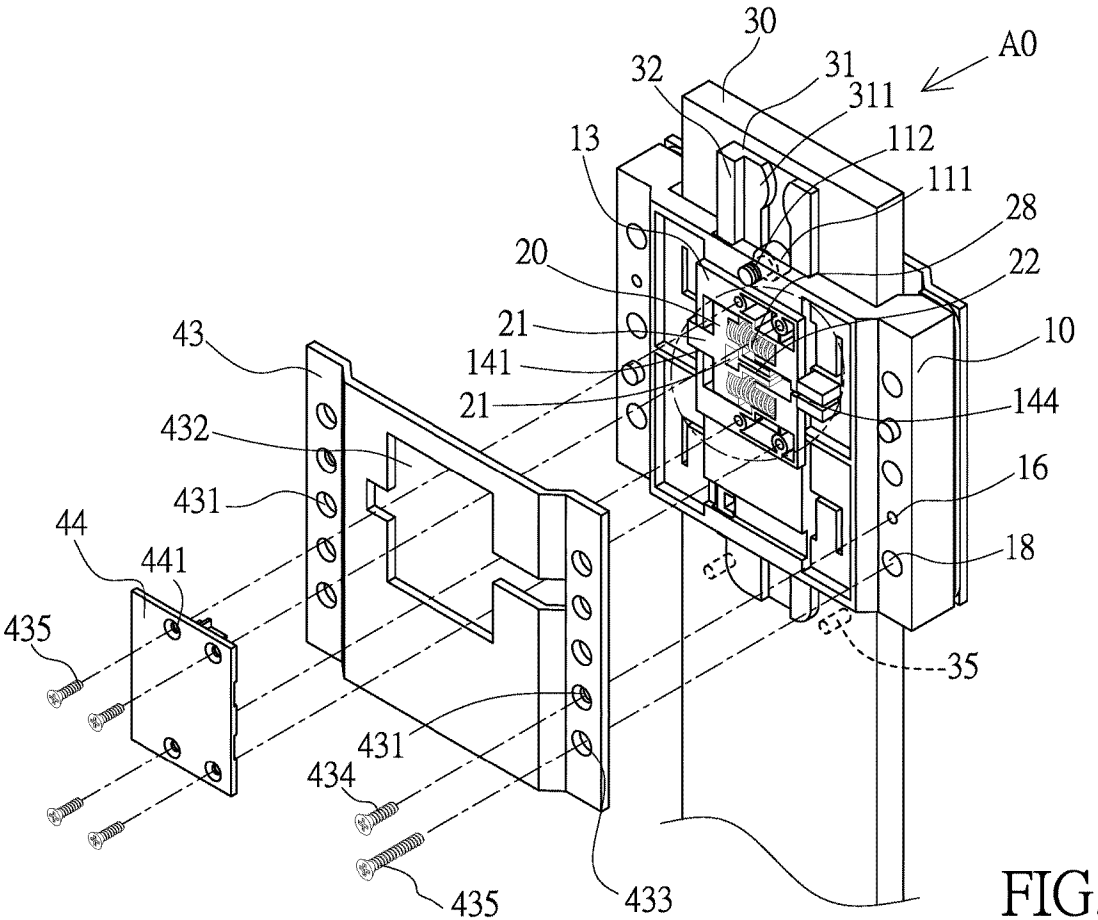
FIG. 2 is a perspective view showing the exploded components of a first adjustment unit of the adjustable lifting structure for the chair back according to the preferred embodiment of the present invention.
Figure 3:
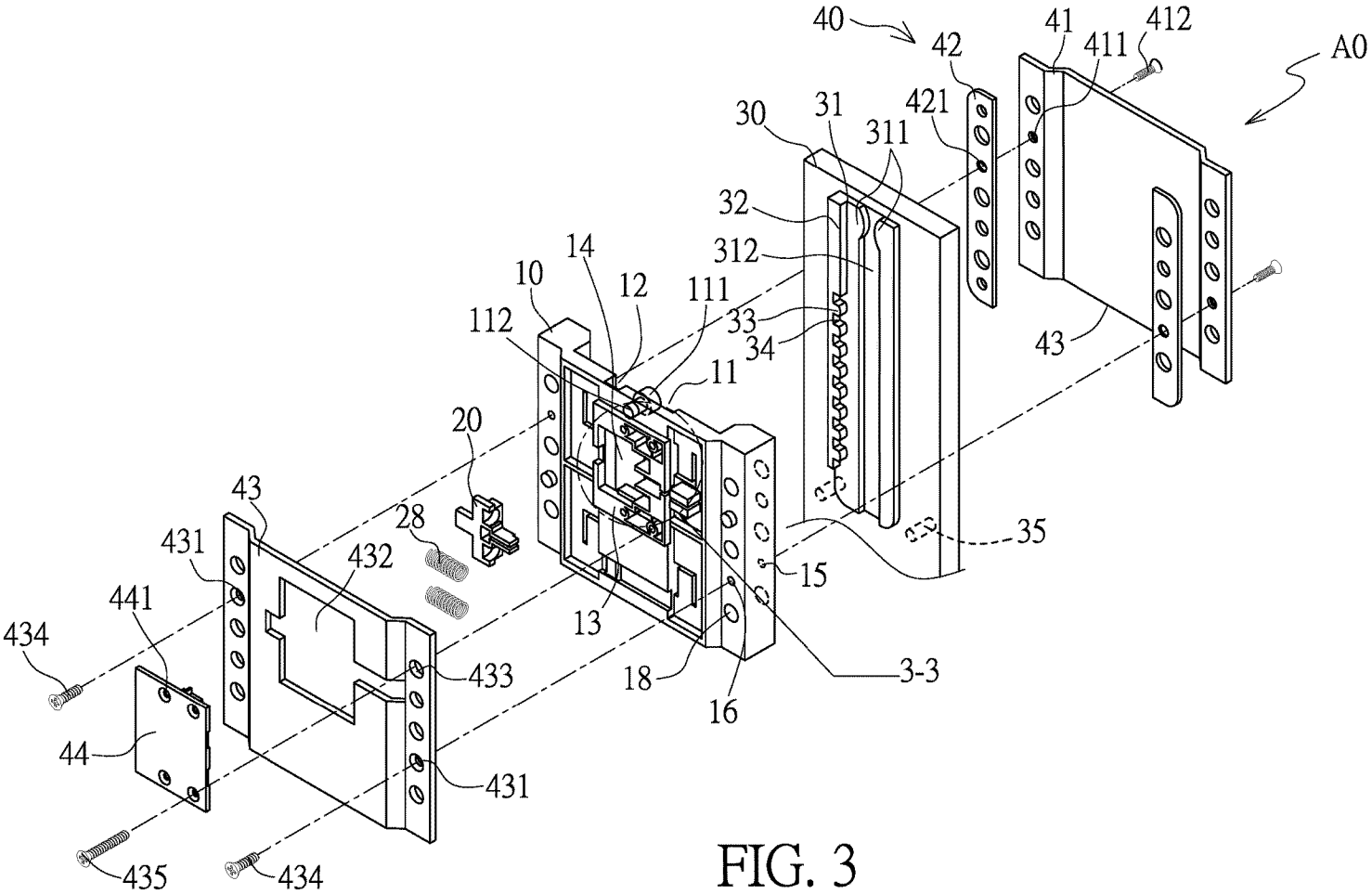
FIG. 3 is another perspective view showing the exploded components of the first adjustment unit of the adjustable lifting structure for the chair back according to the preferred embodiment of the present invention.
Figures 1, 3:
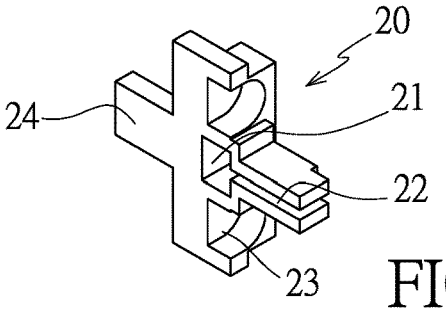
Figures 2, 3:
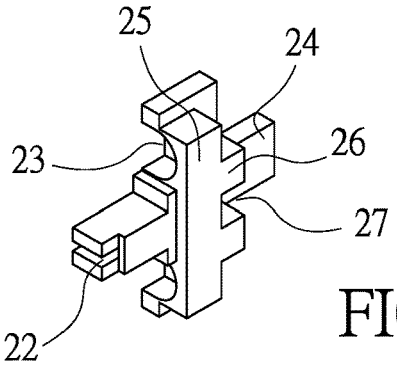
Figure 3:
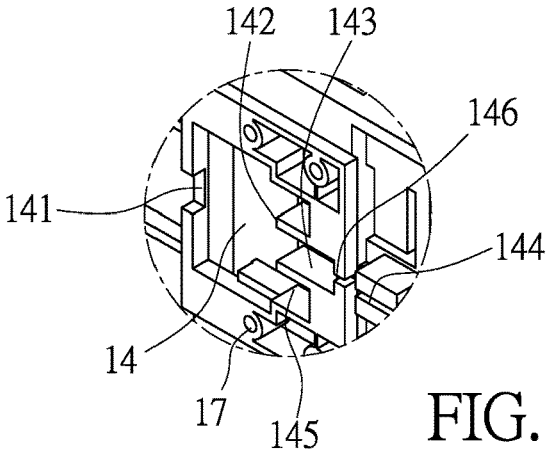
Figure 4:
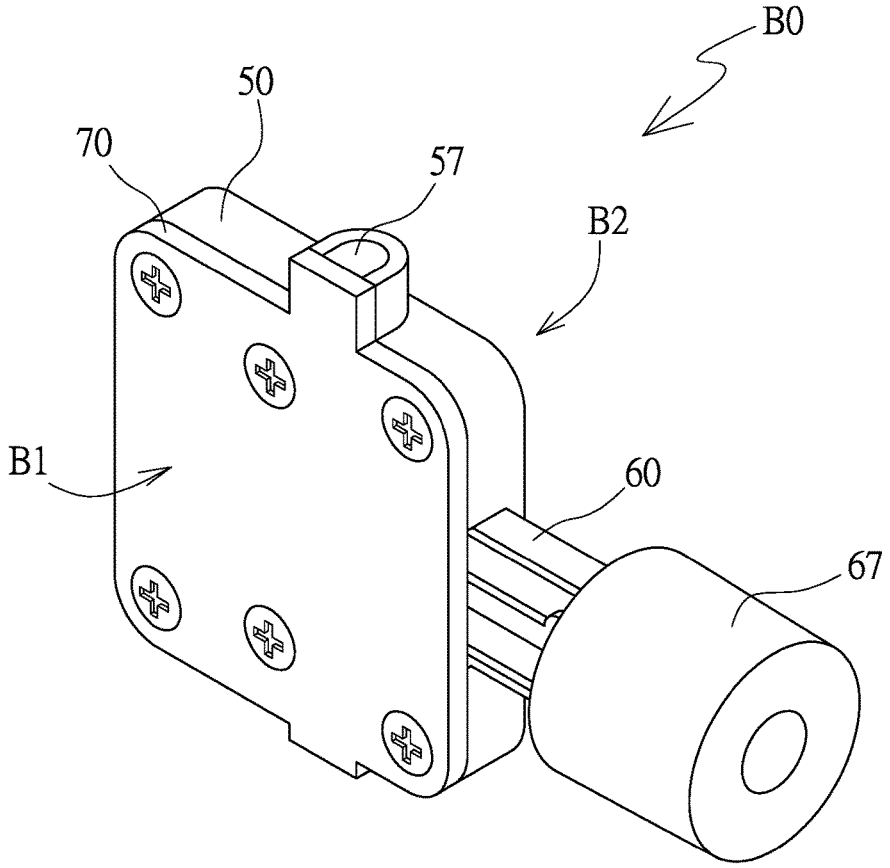
FIG. 4 is a perspective view showing the assembly of a second adjustment unit of the adjustable lifting structure for the chair back according to the preferred embodiment of the present invention.
Figure 5:
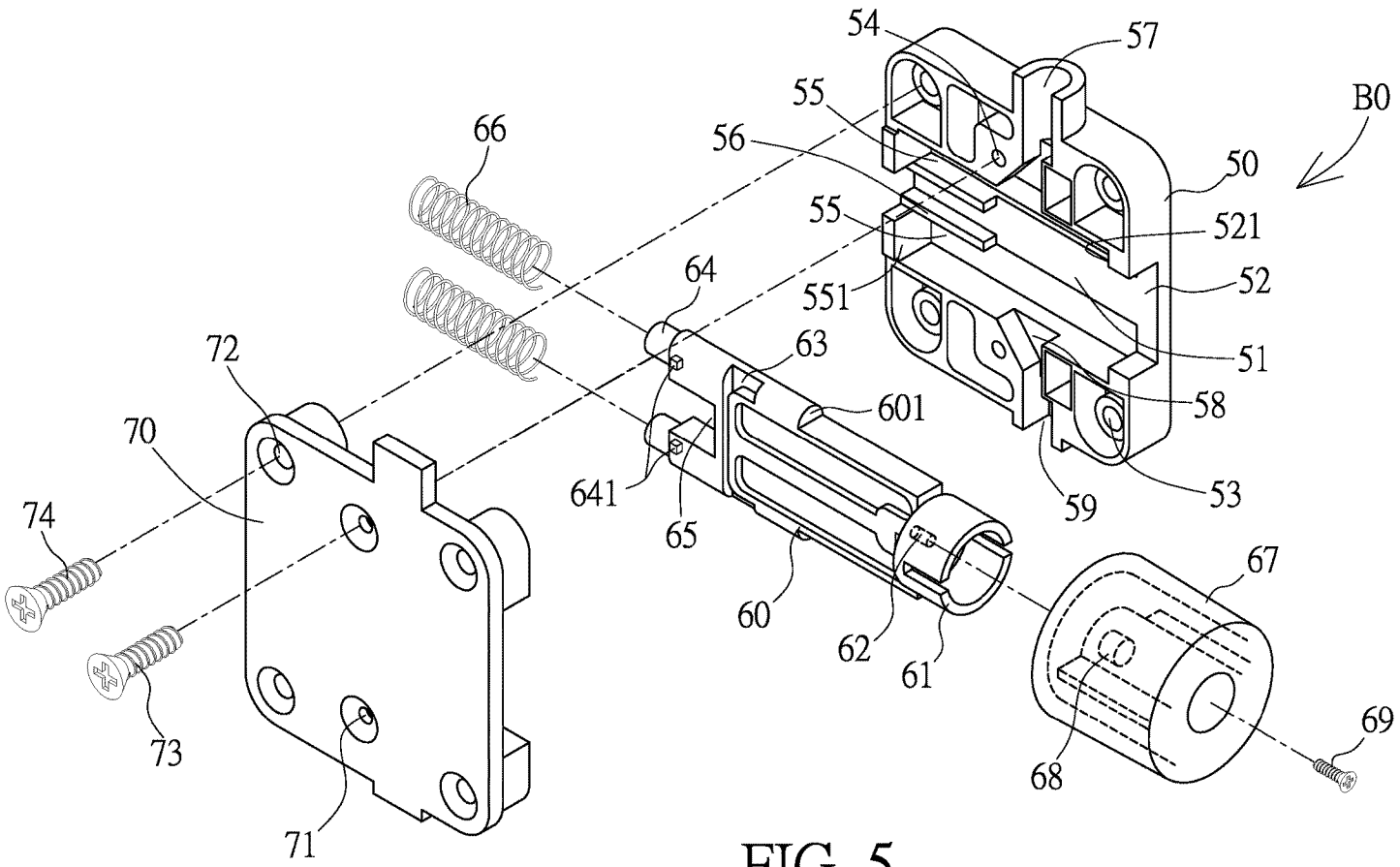
FIG. 5 is a perspective view showing the exploded components of the second adjustment unit of the adjustable lifting structure for the chair back according to the preferred embodiment of the present invention.
Figure 6:
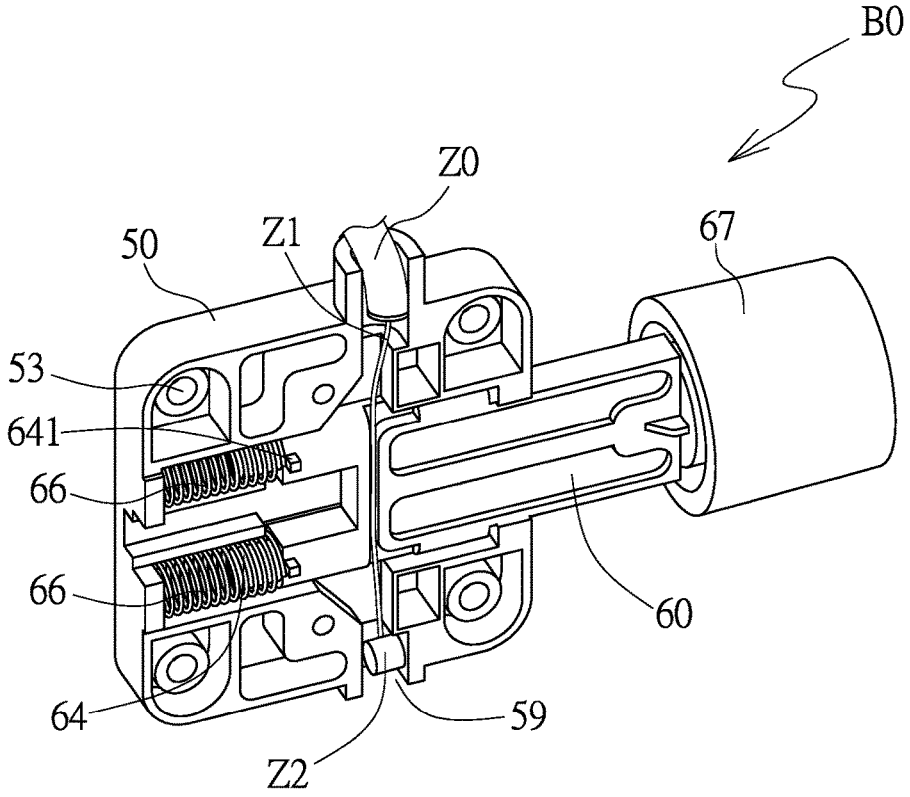
FIG. 6 is a perspective view showing the operation of the second adjustment unit of the adjustable lifting structure for the chair back according to the preferred embodiment of the present invention.
Figure 7:
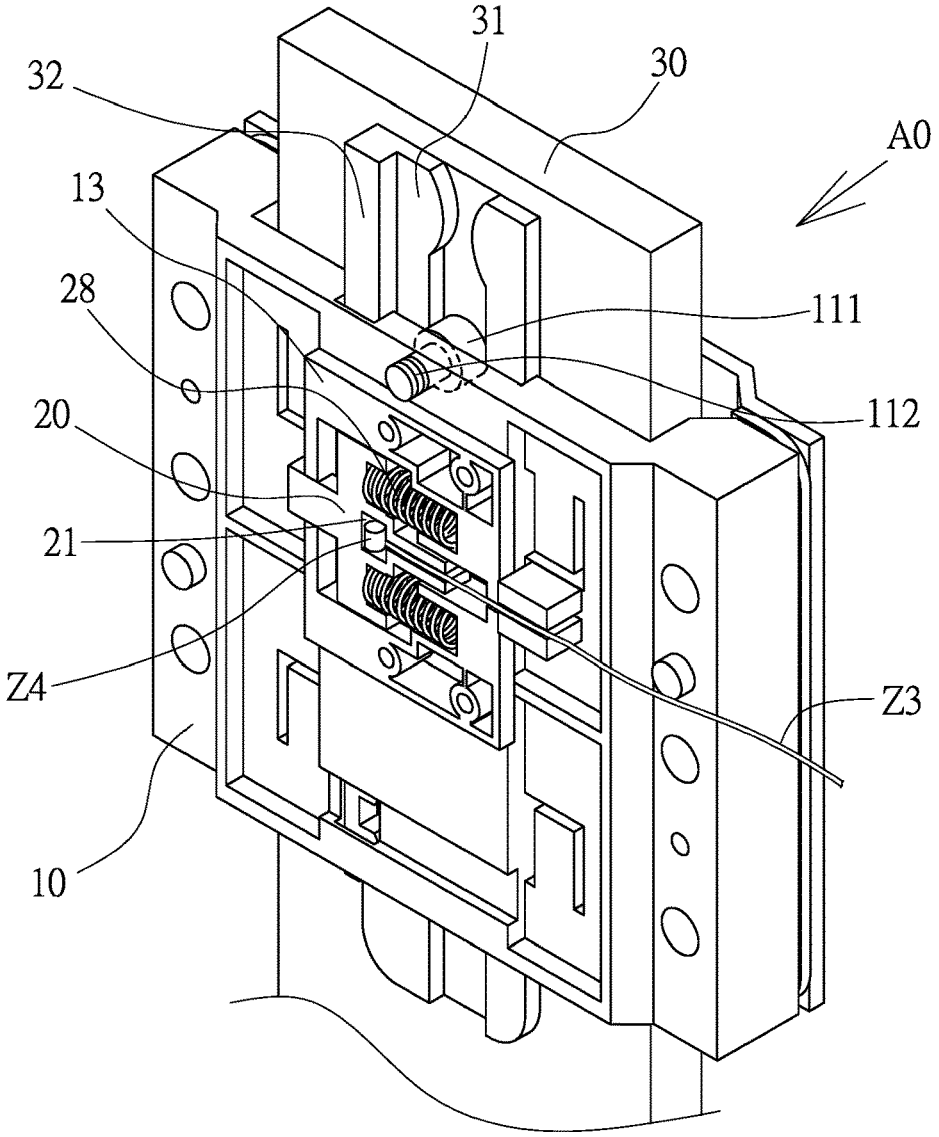
FIG. 7 is a perspective view showing the operation of the first adjustment unit of the adjustable lifting structure for the chair back according to the preferred embodiment of the present invention.
Figure 8:
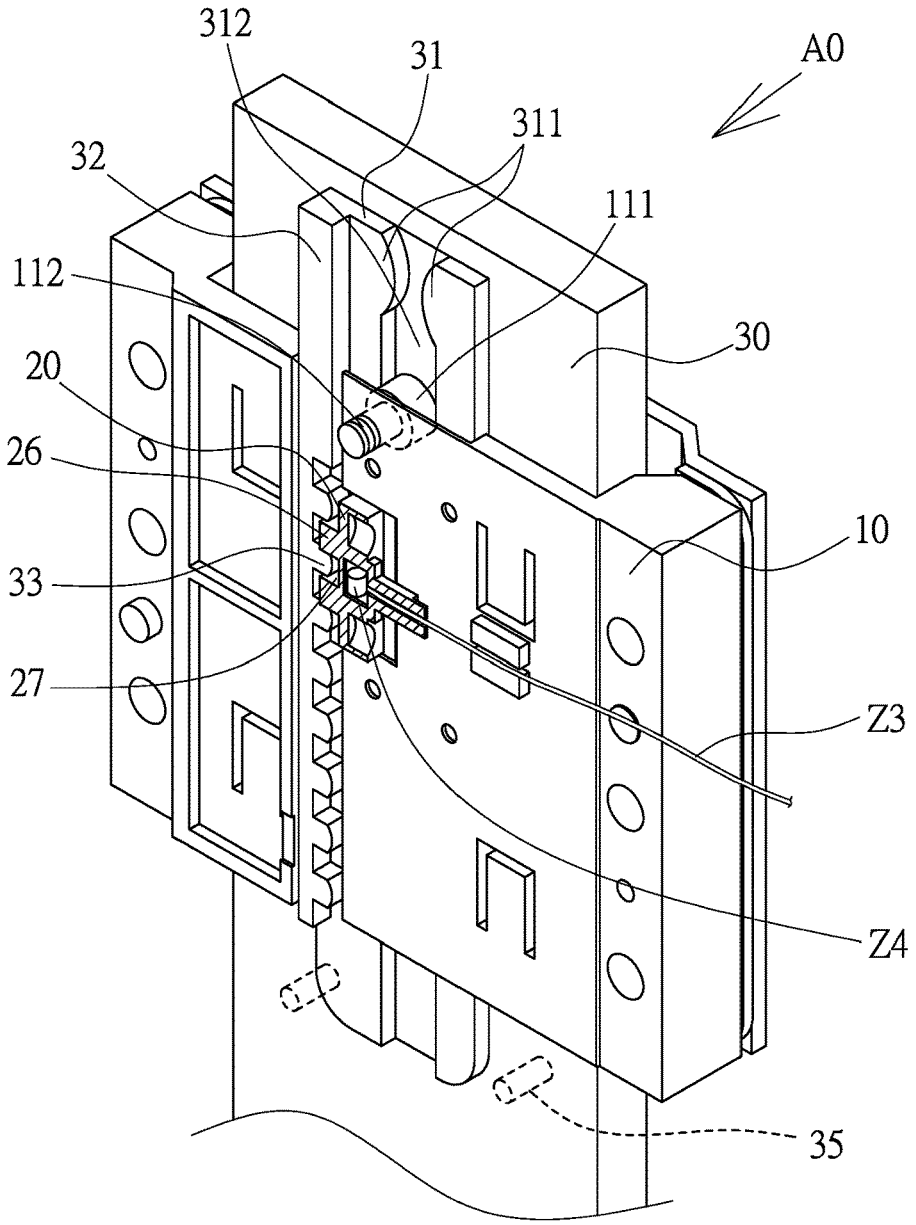
FIG. 8 is another perspective view showing the operation of the first adjustment unit of the adjustable lifting structure for the chair back according to the preferred embodiment of the present invention.
Figure 9:
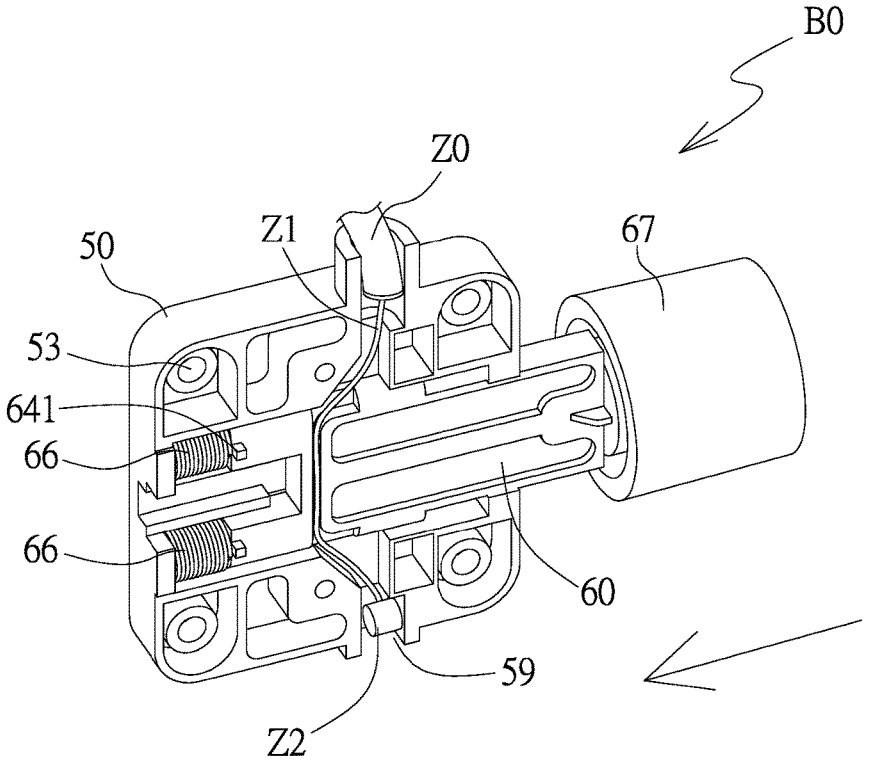
FIG. 9 is another perspective view showing the operation of the second adjustment unit of the adjustable lifting structure for the chair back according to the preferred embodiment of the present invention.
Figure 10:
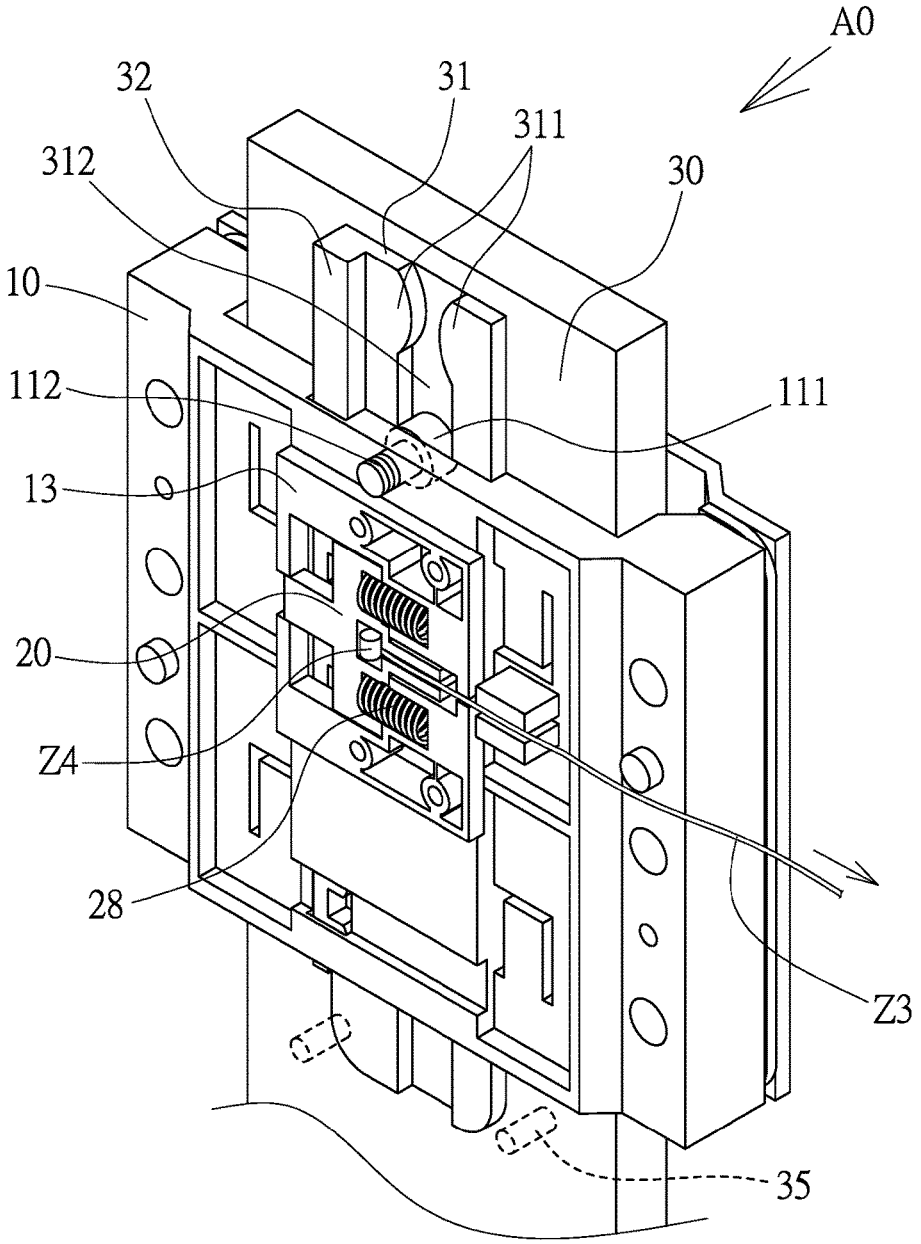
FIG. 10 is also another perspective view showing the operation of the first adjustment unit of the adjustable lifting structure for the chair back according to the preferred embodiment of the present invention.
Figure 11:
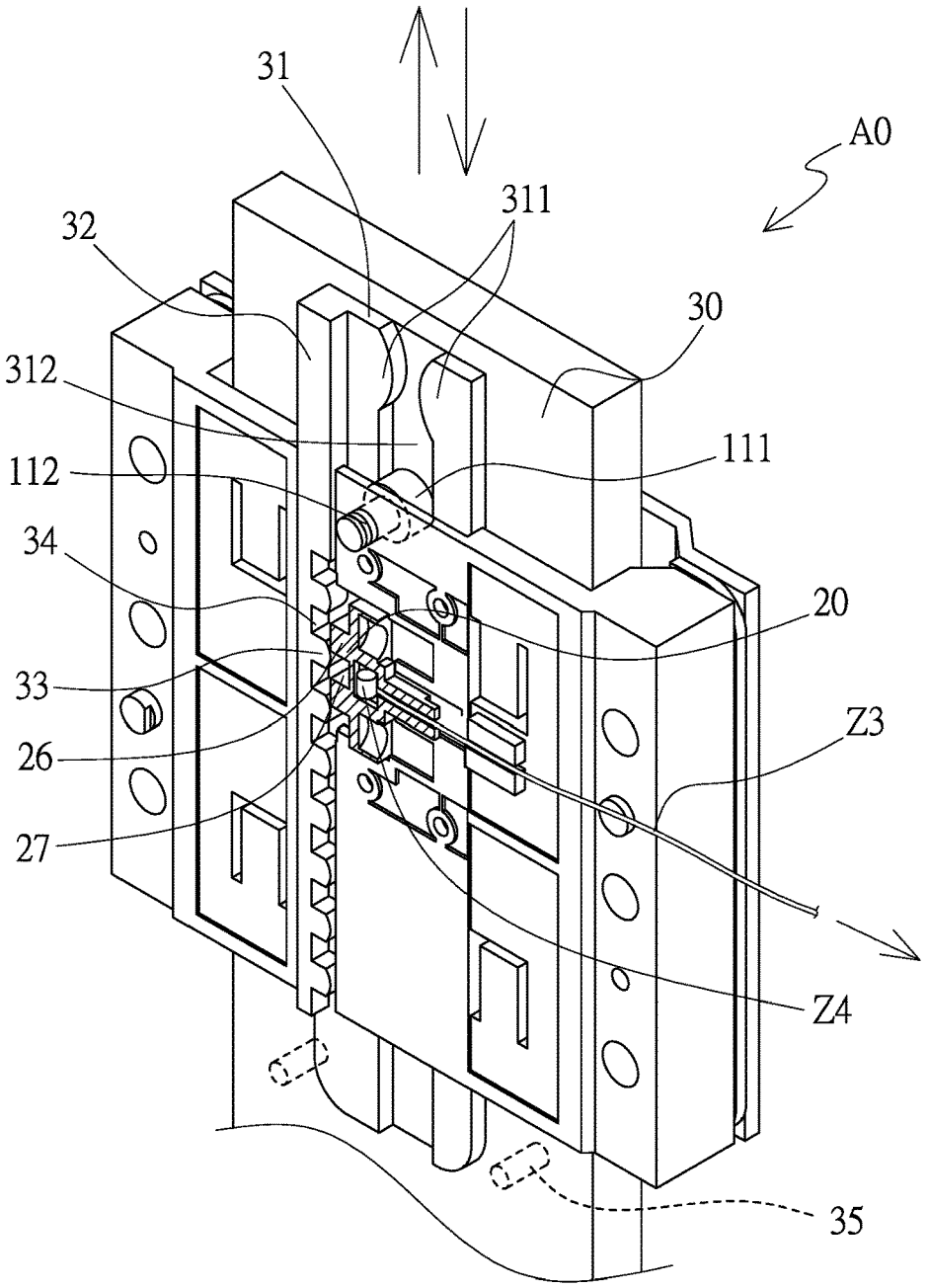
FIG. 11 is still another perspective view showing the operation of the first adjustment unit of the adjustable lifting structure for the chair back according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-5, an adjustable lifting structure for a chair back X1 in accordance with a preferred embodiment of the present invention comprises: a first adjustment unit A0 and a second adjustment unit B0, wherein the first adjustment unit A0 mates with the second adjustment unit B0 via a transmission cable Z0, and the first adjustment unit A0 includes a longitudinally hollow chamber A1 formed therein vertically and configured to slidably accommodate a guide plate 30, and a bottom of the guide plate 30 is connected on a seat X2, the first adjustment unit A0 is disposed on a rear surface of the chair back X1, and the second adjustment unit B0 is fixed on the rear surface of the chair back X1.

The first adjustment unit A0 includes a body 10, two covering assemblies 40 connected on a front end and a rear end of the body 10 respectively so that the longitudinally hollow chamber A1 is defined among the body 10 and the two covering assemblies 40, the body 10 has a protrusion 13 arranged on the front end of the body 10, a receiving groove 14 formed in the protrusion 13 and having a guiding recess 141 defined on a first end of the receiving groove 14, a limiting segment 142 arranged on a second end of the receiving groove 14, a slide recess 143 extending from a center of the limiting segment 142, two flexible spaces 145 formed on two side of the slide recess 143 individually, a first conduct recess 146 defined on a distal end of the slide recess 143, and a second conduct recess 144 extending from an end of the first conduct recess 146.

The body 10 further includes multiple first connection portions 15 and a first coupling orifice 16 which are formed on two sides of the body 10 respectively, wherein the multiple first connection portions 15 and the first coupling orifice 16 are configured to connect with each of the two covering assemblies 40, and the body 10 includes multiple second coupling orifices 18 defined thereof and configured to fix the body 10 on the chair back X1. The body 10 includes a first trench 11 defined on the rear end thereof and includes a second trench 12 longitudinally formed on the body 10, wherein the first trench 11 has an engagement element 111 mounted thereof adjacent to a top of the first trench 11, and the first trench 11 has a screwing portion 112 defined on an end of the engagement element 111 so as to screw on the body 10.

Each covering assembly 40 includes a first lid 43, a second lid 41, two washers 42, and a cap 44, wherein the first lid 43 has a first hole 432 corresponding to the protrusion 13 of the body 10, a second hole 431 corresponding to the first coupling orifice 16 of the body 10, and a first screw bolt 434 configured to screw with the second hole 431 and the first coupling orifice 16. The cap 44 has multiple third holes 441 defined thereof respectively, and the body 10 includes multiple third coupling orifices 17 corresponding to the multiple third holes 441 individually, a second screw bolt 435 inserts through each of the multiple third coupling orifices 17 and each of the multiple third holes 441 so as to screw the cap 44 with the protrusion 13. The second lid 41 has multiple fourth holes 411, and the two washers 42 have two fifth holes 421 corresponding to the multiple fourth holes 411 individually, a third screw bolt 412 inserts through each of the two fifth holes 421 and each of the multiple fourth holes 411 so as to screw with each of the multiple first connection portions 15 of the body 10. The body 10 further includes multiple sixth holes 433, each of which screws with the second screw bolt 435 on the chair back X1.

A drive block 20 includes a locking space 21 defined on a front surface thereof, a slit 22 extending from an end of the locking space 21, two deformable chambers 23 defined on two sides of the locking space 21 respectively, a driving segment 24 formed on a first end of the drive block 20, a retainer 25 formed on a rear surface of the drive block 20, a trough 27 defined on a center of a side of the retainer 25, and two projections 26 formed on two sides of the trough 27 respectively; wherein the retainer 25 is accommodated in the receiving groove 14 of the body 10 so that the locking space 21 and the two deformable chambers 23 are defined outwardly, the retainer 25 is formed inwardly, and the trough 27 and the two projections 26 correspond to the second trench 12 of the body 10.

The guide plate 30 includes a conducting element 31 arranged on a surface thereof, a rail 32 defined on a side of the conducting element 31 so that after the guide plate 30 is slidably accommodated in the first trench 11 of the body 10, the rail 32 is slidably housed in the second trench 12. The rail 32 has multiple teeth 33 and multiple cutouts 34 which are connected together, and each of the multiple teeth 33 is defined between any two adjacent of the multiple cutouts 34, such that the multiple teeth 33 and the multiple cutouts 34 individually correspond to and retain with the two projections 26 and the trough 27 of the drive block 20. The conducting element 31 has a channel 312 longitudinally formed thereof and configure to slidably house the engagement element 111 of the body 10, wherein the channel 312 has two raised portions 311 extending inwardly and located adjacent to a top of the channel 312 so as to abut against two sides of the engagement element 111 respectively. Furthermore, the guide plate 30 further includes two stopping posts 35 arranged on a rear end thereof adjacent to two sides of a distal end of the conducting element 31 respectively, and each of the two stopping posts 35 retains on a bottom rim 43 of the second lid 41 of each covering assembly 40 of the first adjustment unit A0.

The second adjustment unit B0 includes an adjuster 50, an operation cavity 51 defined in the adjuster 50, a first aperture 52 formed on a first end of the operation cavity 51, wherein the first aperture 52 has two first shoulders 521 formed on two inner surfaces thereof respectively, two connecting rooms 55 formed on a second end of the operation cavity 51, two stop segments 56 formed on two distal ends of two sides of the connecting room 55 individually, and the two connection rooms 55 have two second shoulders 551 individually formed on two distal ends of the two connection rooms 55. The adjuster 50 further has a second aperture 57 defined on a first side thereof, an indentation 59 arranged on a second side of the adjuster 50 opposite to the first side of the adjuster 50, a third aperture 54 defined on the adjuster 50 such that a fixing element 73 inserts through the third aperture 54 so as to connect with a second connection portion 71 of an adjustment cover 70 which is coupled on the adjuster 50. Two front and rear surfaces of a connection of the adjuster 50 and the adjustable cover 70 respectively have a first connection face B1 and a second connection face B2, and the first connection face B1 and the second connection face B2 are a plane. The adjuster 50 has multiple fourth apertures 53 formed thereof respectively. The adjustment cover 70 has multiple affix portions 72 corresponding to the multiple fourth apertures 53, multiple lock elements 74 connected on the chair back X1 via the multiple affix portions 72 and the multiple fourth apertures 53 individually, and because the first connection face B1 and the second connection face B2 are a plane, the second adjustment unit B0 is turned based on customized requirements to adjustably fix the first connection face B1 on the chair back X1, as illustrated in FIG. 1, or is turned to fix the second connection face B2 on the chair back X1. A movable rod 60 is slidably housed in the operation cavity 51 of the adjuster 50, the movable rod 60 includes a third shoulder 601 movably stopped on the two first shoulders 521 of the first aperture 52, wherein the movable rod 60 has a recessed segment 65 defined on a first end thereof and slidably limited by two stop segments 56 of the adjuster 50, two positioning columns 64 respectively extending from two sides of an inner wall of the recessed segment 65 and configured to fit with the two resilient elements 66 respectively, two lock blocks 641 are respectively arranged on the two sides of the inner wall of the recessed segment 65 proximate to the two positioning columns 64, hence the two resilient elements 66 are accommodated in the connecting room 55 of the adjuster 50 and stop on the two lock blocks 641 individually, another end of each resilient element 66 stops on the two second shoulders 551. The movable rod 60 has a notch 63 corresponding to the second aperture 57 and the indentation 59 of the adjuster 50, and the movable rod 60 includes a locating segment 61 formed on another end thereof and a receiving orifice 62 defined on an inner surface of the locating segment 61; a press element 67 having a defining portion 68 corresponding to the receiving orifice 62, the defining portion 68 and the receiving orifice 62 facilitate a connection of the press element 67 and the locating segment 61 of the movable rod 60 via a mounting element 67.

The transmission cable Z0 includes a first transmitting segment Z1 and a second transmitting segment Z3 which are defined on two ends of the transmission cable Z0 respectively, wherein the first transmitting segment Z1 has a first defining portion Z2 formed on a distal end thereof, and the second transmitting segment Z3 has a second defining portion Z4 defined on a distal end thereof, wherein the first transmitting segment Z1 is fixed in the second aperture 57 of the adjuster 50, the notch 63 of the movable rod 60, and a dent 58 of the adjuster 50 so that the first defining portion Z2 of the distal end of the first transmitting segment Z1 is limited in the indentation 59 of the adjuster 50. The second transmitting segment Z3 is fixed in the second conduct recess 144 and the first conduct recess 146 of the body 10 and the slit 22 of the drive block 20 so that the second defining portion Z4 of the distal end of the second transmitting segment Z3 is limited in the locking space 21 of the drive block 20.

Referring to FIGS. 6-11, as desiring to lift the chair back X1, the pull ring 67 of the second adjustment unit B0 is pulled so that the notch 63 of the movable rod 60 pulls the first transmitting segment Z1 of the transmission cable Z0, and the drive block 20 of the first adjustment unit A0 is pulled by the second transmitting segment Z3 so that the trough 27 and the two projections 26 of the drive block 20 remove from the multiple teeth 33 and the multiple cutouts 34 of the rail 32 individually, and user manually pulls the chair back X1 to move longitudinally relative to the guide plate 30. After adjusting the chair back X1 to a desired position, the pull ring 67 is released so that the two resilient elements 66 push the movable rod 60 to move back to an original position, and the drive bock 20 is pushed by the two resilient elements 28 to urge the trough 27 and the two projections 26 to engage with the multiple teeth 33 and the multiple cutouts 34 respectively, and the chair back X1, the seat X2 and the guide plate 30 are positioned, thus adjustably lifting the chair back X1.

Figure 12:
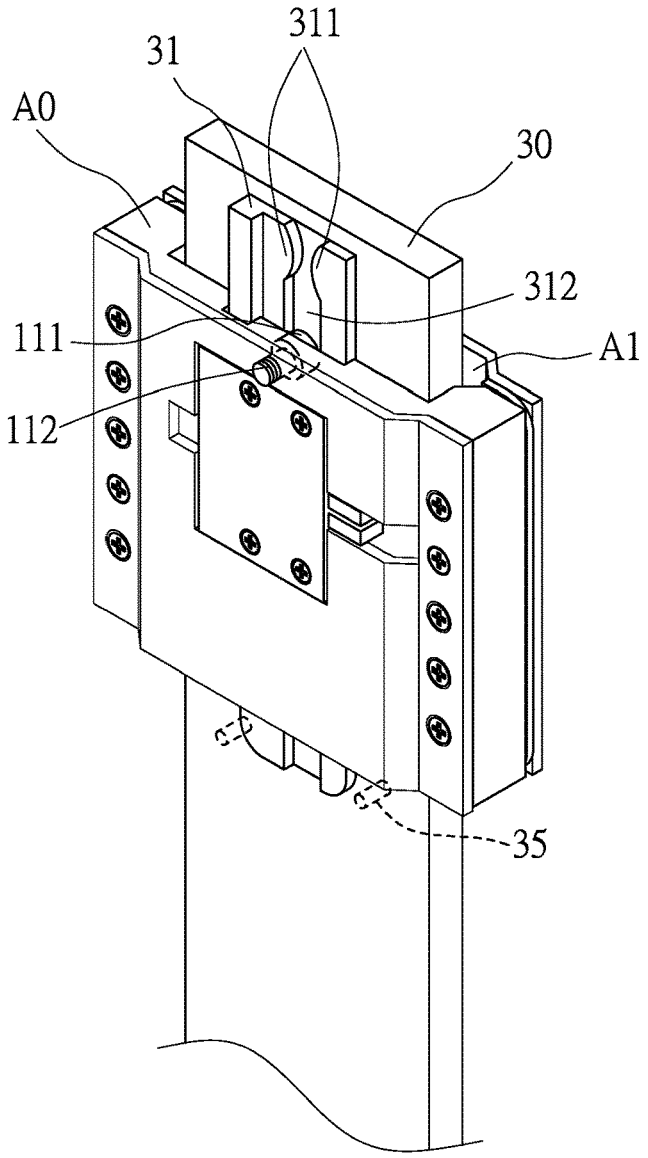
FIG. 12 is a perspective view showing the assembly of the first adjustment unit and a guide plate of the adjustable lifting structure for the chair back according to the preferred embodiment of the present invention.
Figure 13:
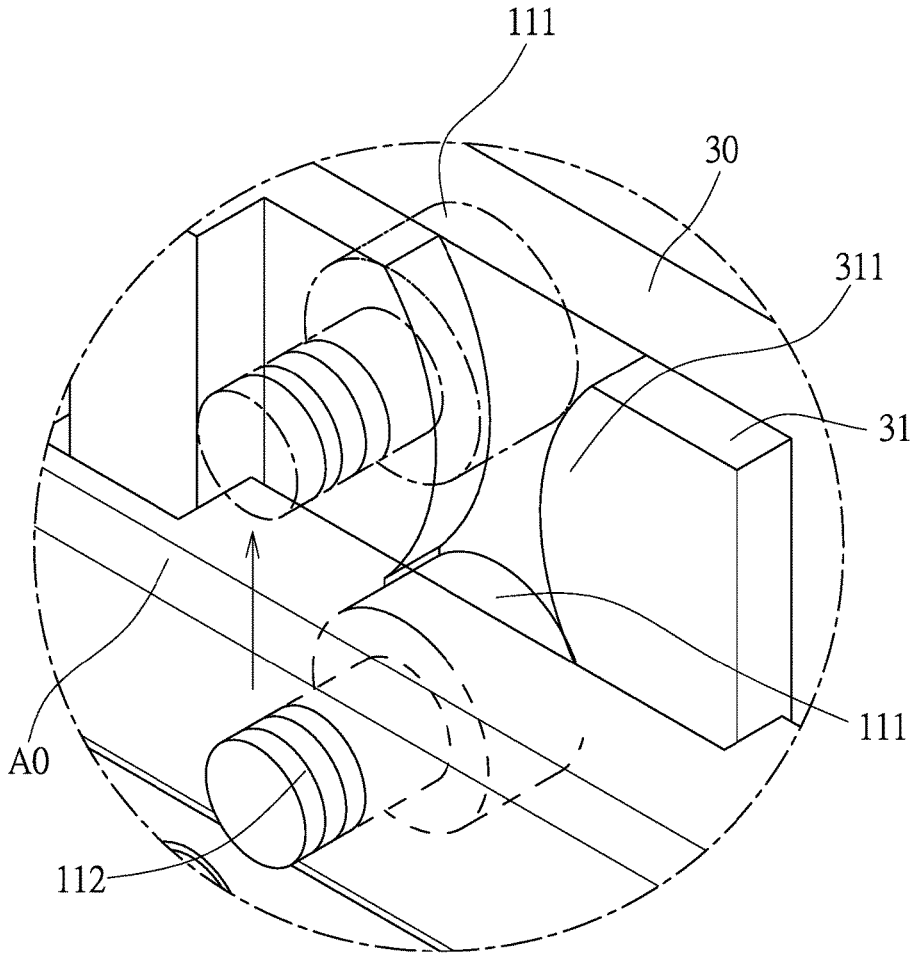
FIG. 13 is a perspective view showing the operation of the first adjustment unit and the guide plate of the adjustable lifting structure for the chair back according to the preferred embodiment of the present invention.
Figure 14:
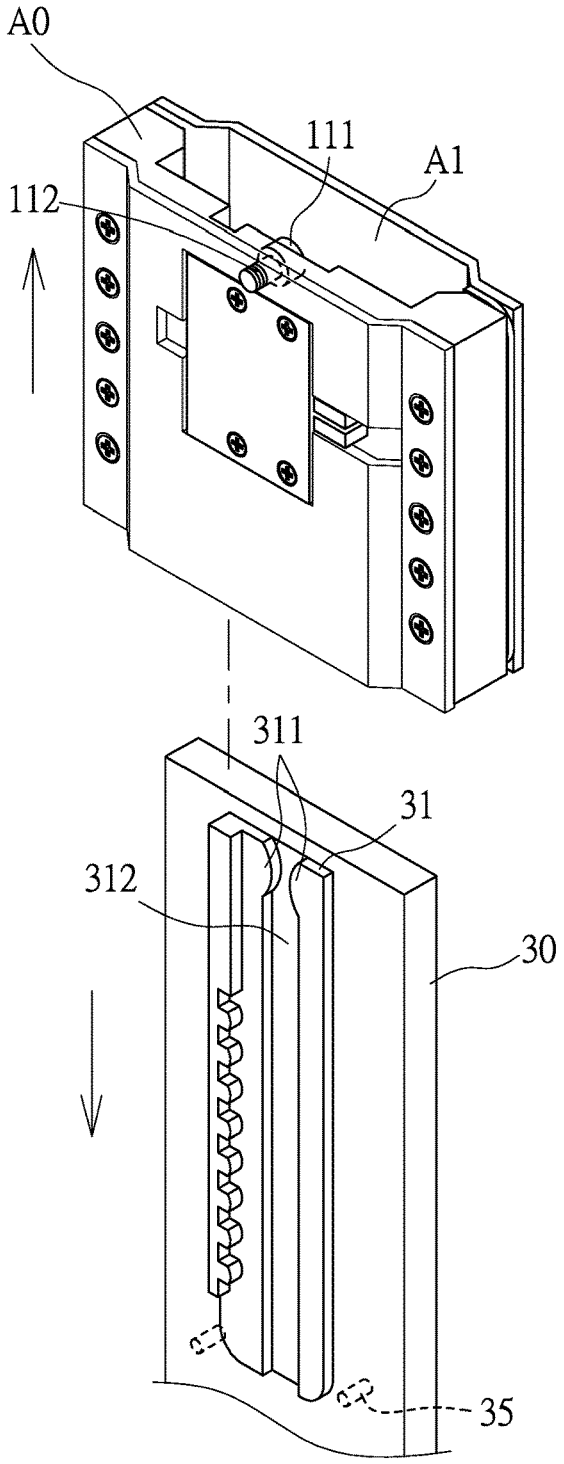
FIG. 14 is a perspective view showing the exploded components of the first adjustment unit and the guide plate of the adjustable lifting structure for the chair back according to the preferred embodiment of the present invention.

As illustrated in FIGS. 12-14, as desiring to remove the guide plate 30 from the longitudinally hollow chamber A1 of the first adjustment unit A0, the engagement element 111 is pulled upward so as to move across and being against the two raised portions 311, hence the guide plate 30 removes from the longitudinally hollow chamber A1 of the first adjustment unit A0 so as to store the guide plate 30 and the first adjustment unit A0.

Figure 15:
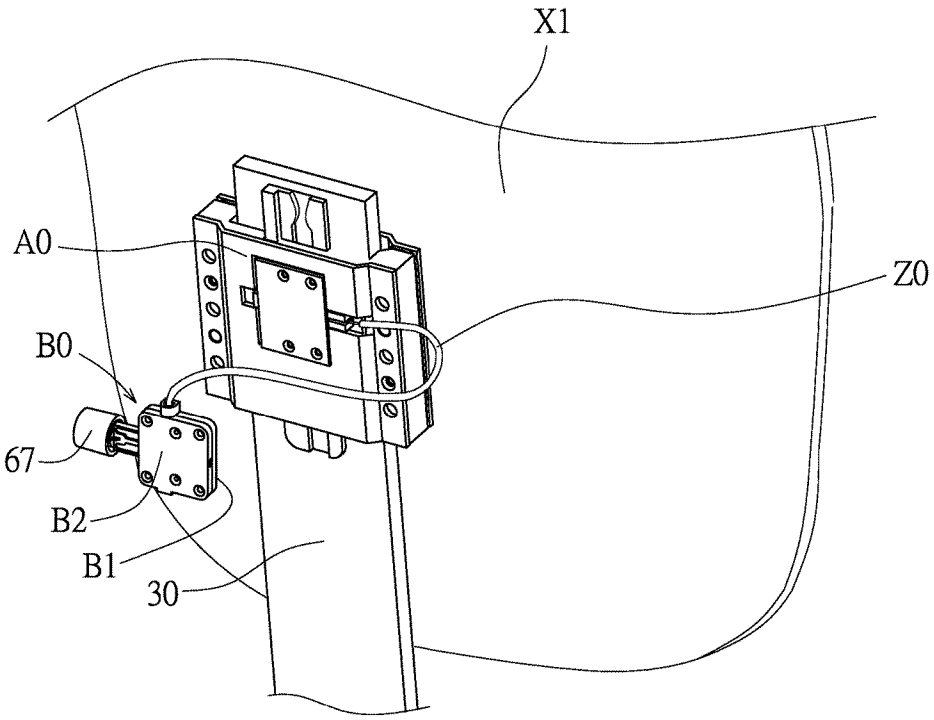
FIG. 15 is perspective view showing the application of the adjustable lifting structure for the chair back according to the preferred embodiment of the present invention.

Referring to FIGS. 1 and 15, the second adjustment unit B0 is turned based on customized requirements, as shown in FIG. 1, hence the second connection face B2 is fixed on the chair back X1, and the press element 67 facing right forms a right angle position. As illustrated in FIG. 15, the first connection face B1 is fixed on the chair back X1 and the press element 67 facing to left forms a left angle position.

While various embodiments in accordance with the present invention have been shown and described, it is clear to those skilled in the art that further embodiments may be made without departing from the scope of the present invention.

What is claimed is:

1. An adjustable lifting structure for a chair back comprising: a first adjustment unit and a second adjustment unit, wherein the first adjustment unit mates with the second adjustment unit via a transmission cable, the first adjustment unit includes a longitudinally hollow chamber formed therein vertically and configured to slidably accommodate a guide plate, a bottom of the guide plate is connected on a seat, the first adjustment unit is disposed on a rear surface of the chair back, and the second adjustment unit is fixed on the rear surface of the chair back; wherein:

the first adjustment unit includes a body, a covering assembly connected on a front end and a rear end of the body respectively so that the longitudinally hollow chamber is defined among the body and the covering assembly, the body has a protrusion arranged on the front end of the body, a receiving groove formed in the protrusion and having a guiding recess defined on a first end of the receiving groove, a limiting segment arranged on a second end of the receiving groove, a slide recess extending from a center of the limiting segment, two flexible spaces formed on two sides of the slide recess individually, a first conduct recess defined on a distal end of the slide recess, and a second conduct recess extending from an end of the first conduct recess;

the body further includes multiple first connection portions and a first coupling orifice which are formed on two sides of the body respectively, wherein the multiple first connection portions and the first coupling orifice are configured to connect with the covering assembly, and the body includes multiple second coupling orifices defined thereof and configured to fix the body on the chair back; the body includes a first trench defined on the rear end thereof and includes a second trench longitudinally formed on the body, wherein the first trench has an engagement element mounted thereof adjacent to a top of the first trench, and the engagement element has a screwing portion defined on an end thereof so as to screw on the body;

a drive block includes a locking space defined on a front surface thereof, a slit extending from an end of the locking space, two deformable chambers defined on two sides of the locking space respectively, a driving segment formed on a first end of the drive block, a retainer formed on a rear surface of the drive block, a trough defined on a center of a side of the retainer, and two projections formed on two sides of the trough respectively; wherein the retainer is accommodated in the receiving groove of the body so that the locking space and the two deformable chambers are defined forwardly, the retainer is formed rearwardly, and the trough and the two projections are in the second trench of the body;

the guide plate includes a conducting element arranged on a surface thereof, a rail defined on a side of the conducting element so that after the guide plate is slidably accommodated in the first trench of the body, the rail is slidably housed in the second trench; the rail has multiple teeth and multiple cutouts which are connected together, and each of the multiple teeth is defined between any two adjacent of the multiple cutouts, such that the multiple teeth and the multiple cutouts individually engage and retain with the two projections and the trough of the drive block; the conducting element has a channel longitudinally formed thereof and configured to slidably house the engagement element of the body, wherein the channel has two raised portions extending inwardly and located adjacent to a top of the channel so as to abut against two sides of the engagement element respectively; the guide plate further includes two stopping posts arranged on a rear end of the guide plate adjacent to two sides of a distal end of the conducting element respectively, and each of the two stopping posts retains on a bottom rim of a lid of the covering assembly of the first adjustment unit;

the second adjustment unit includes an adjuster, an operation cavity defined in the adjuster, a first aperture formed on a first end of the operation cavity, wherein the first aperture has two first shoulders formed on two inner surfaces thereof respectively, two connecting rooms formed on a second end of the operation cavity, two stop segments formed on two distal ends of two walls of the connecting rooms individually, and the two connection rooms have two second shoulders individually formed on two distal ends of the two connection rooms; the adjuster further has a second aperture defined on a first side thereof, an indentation arranged on a second side of the adjuster opposite to the first side of the adjuster, a third aperture defined on the adjuster such that a fixing element inserts through the third aperture so as to connect with a second connection portion of an adjustment cover which is coupled to the adjuster; a movable rod is slidably housed in the operation cavity of the adjuster, the movable rod includes a third shoulder movably stopped on the two first shoulders of the first aperture, wherein the movable rod has a recessed segment defined on a first end thereof and slidably limited by the two stop segments of the adjuster, two positioning columns respectively extending from two sides of an inner wall of the recessed segment and configured to fit with the two resilient elements respectively, two lock blocks are respectively arranged on the two sides of the inner wall of the recessed segment proximate to the two positioning columns, hence the two resilient elements are accommodated in the connecting room of the adjuster and stop on the two lock blocks individually, another end of each resilient element stops on the two second shoulders, the movable rod has a notch in general alignment with the second aperture and the indentation of the adjuster, and the movable rod includes a locating segment formed on another end thereof and a receiving orifice defined on an inner surface of the locating segment; a press element has a defining portion connected to the receiving orifice, the defining portion and the receiving orifice facilitate a connection of the press element and the locating segment of the movable rod via a mounting element;

a transmission cable includes a first transmitting segment and a second transmitting segment which are defined on two ends of the transmission cable respectively, wherein the first transmitting segment has a first defining portion formed on a distal end thereof, and the second transmitting segment has a second defining portion defined on a distal end thereof, wherein the first transmitting segment is fixed in the second aperture of the adjuster, the notch of the movable rod, and a dent of the adjuster so that the first defining portion of the distal end of the first transmitting segment is limited in the indentation of the adjuster; the second transmitting segment is fixed in the second conduct recess and the first conduct recess of the body and the slit of the drive block so that the second defining portion of the distal end of the second transmitting segment is limited in the locking space of the drive block.

2. The adjustable lifting structure as claimed in claim 1, wherein the covering assembly includes the lid, a further lid, two washers, and a cap, wherein the further lid has a first hole corresponding in position to the protrusion of the body, a second hole corresponding in position to the first coupling orifice of the body, and a first screw bolt configured to screw with the second hole and the first coupling orifice, the cap has multiple third holes defined thereof respectively, and the body includes multiple third coupling orifices corresponding in position to the multiple third holes individually, a second screw bolt inserts through each of the multiple third coupling orifices and each of the multiple third holes so as to screw the cap with the protrusion; the further lid has multiple fourth holes, and the two washers have two fifth holes corresponding in position to the multiple fourth holes individually, a third screw bolt inserts through each of the two fifth holes and each of the multiple fourth holes so as to screw with each of the multiple first connection portions of the body.

* * * * *